US008968014B2

(12) United States Patent
Russell

(10) Patent No.: US 8,968,014 B2
(45) Date of Patent: Mar. 3, 2015

(54) CONNECTOR COVER FOR PROTECTING A CONNECTION FROM CONTAMINANTS

(75) Inventor: John Russell, Cologne, MN (US)

(73) Assignee: ACIST Medical Systems, Inc., Eden Prairie, MN (US)

( * ) Notice: Subject to any disclaimer, the term of this patent is extended or adjusted under 35 U.S.C. 154(b) by 286 days.

(21) Appl. No.: 13/554,297

(22) Filed: Jul. 20, 2012

(65) Prior Publication Data

US 2014/0024235 A1 Jan. 23, 2014

(51) Int. Cl.
*H01R 13/453* (2006.01)
*H01R 43/20* (2006.01)
*H01R 13/52* (2006.01)

(52) U.S. Cl.
CPC ..... *H01R 13/4536* (2013.01); *H01R 43/20* (2013.01); *H01R 13/5213* (2013.01)
USPC ..... 439/137

(58) Field of Classification Search
USPC ..... 439/131–144; 385/75–95, 139
See application file for complete search history.

(56) References Cited

U.S. PATENT DOCUMENTS

| | | | | |
|---|---|---|---|---|
| 5,030,120 | A | 7/1991 | Hartley | |
| 5,363,460 | A * | 11/1994 | Marazzi et al. | 385/70 |
| 5,708,745 | A * | 1/1998 | Yamaji et al. | 385/92 |
| 6,108,482 | A * | 8/2000 | Roth | 385/139 |
| 6,142,676 | A | 11/2000 | Lu | |
| 6,154,597 | A * | 11/2000 | Roth | 385/139 |
| 6,764,222 | B1 * | 7/2004 | Szilagyi et al. | 385/55 |
| 7,144,163 | B2 * | 12/2006 | Tanaka et al. | 385/75 |
| 7,469,091 | B2 | 12/2008 | Mullaney et al. | |
| 7,534,115 | B2 * | 5/2009 | Murano et al. | 439/138 |
| 7,651,346 | B2 * | 1/2010 | Francis et al. | 439/136 |
| 7,820,909 | B2 * | 10/2010 | Castaldo et al. | 174/53 |
| 8,057,244 | B2 * | 11/2011 | Bernstein et al. | 439/135 |
| 8,142,211 | B2 * | 3/2012 | Bernstein et al. | 439/135 |
| 2003/0077929 | A1 * | 4/2003 | Funatsu | 439/137 |
| 2003/0148645 | A1 * | 8/2003 | Hashimoto | 439/137 |
| 2004/0141693 | A1 * | 7/2004 | Szilagyi et al. | 385/55 |

(Continued)

FOREIGN PATENT DOCUMENTS

| | | |
|---|---|---|
| DE | 102009044343 | 5/2011 |
| EP | 1677391 | 12/2007 |

OTHER PUBLICATIONS

Notification of Transmittal of the International Search Report and the Written Opinion of the International Searching Authority, or the Declaration of corresponding application PCT/US2012/047587 mailed Mar. 14, 2013, 13 pages.

*Primary Examiner* — Briggitte R Hammond
(74) *Attorney, Agent, or Firm* — Fredrikson & Byron, P.A.

(57) ABSTRACT

A connector cover may be used to protect a connector from exposure to environmental contaminants and physical abuse. In some examples, the connector cover includes a housing defining an opening that is configured to receive a connector positioned on the end of a transmission line. The housing may contain a complementary connector for mating with the transmission line connector. The connector cover may also include first and second doors positioned to cover different portions of the opening. In use, the doors may bias together when the connector is not inserted into the housing so as to keep the opening closed. Upon inserting the connector into the opening, the connector cover doors may move apart in response to the connector physically contacting the doors. This may allow a user to insert the connector into the connector cover without using their hands to touch the doors, which may transfer contaminants.

24 Claims, 4 Drawing Sheets

(56) References Cited

U.S. PATENT DOCUMENTS

| | | | | |
|---|---|---|---|---|
| 2005/0026481 | A1 | 2/2005 | Nishio et al. | |
| 2005/0135752 | A1* | 6/2005 | Kiani et al. | 385/55 |
| 2007/0047881 | A1* | 3/2007 | Mizuno | 385/92 |
| 2009/0017656 | A1* | 1/2009 | Lee | 439/144 |
| 2011/0043371 | A1* | 2/2011 | German et al. | 340/815.45 |
| 2012/0155825 | A1* | 6/2012 | Ko | 385/139 |
| 2012/0208384 | A1 | 8/2012 | Lazzaro | |

* cited by examiner

CONNECTOR COVER FOR PROTECTING A CONNECTION FROM CONTAMINANTS

TECHNICAL FIELD

This disclosure relates to connectors and, more particularly, to connector covers for protecting a connection from contaminants.

BACKGROUND

Transmission lines are used in a variety of industries to convey different types of media, such as electricity, light, and fluid, from one location to another. To enable a transmission line to connect to another device, a connector is typically provided on one or both ends of the transmission line with a complementary connector provided on the device to which the transmission line is to connect. Mating the connector on the end of the transmission line with the complementary connector on the device can establish an unbroken pathway for conveying a media between the transmission line and the device.

While a connector on a transmission line provides a convenient mechanism for mating the transmission line with various devices, the connector can also provide an access point through which environmental contaminants can enter the transmission line. For example, dust, debris, bacteria, or other environmental contaminants may enter the transmission line at the junction between the connector and the complementary connector on the device, for example, when the two components are unattached and exposed to the environment.

Although environmental contaminants may not be a problem in some applications, in other applications, environmental contaminants may render a transmission line or a connector on a transmission line unsuitable for use. For example, if an optical connector on an optical transmission line is exposed to even small particles of dust, the dust particles can damage or completely block light transmission through the connector. As another example, if an electrical connector on an electrical transmission line is exposed to moisture, the moisture may corrode the electrical connector and block electricity transmission through the connector. Accordingly, ensuring that a connection between a transmission line connector and a complementary connector on a device is blocked from exposure to environmental contaminants may be useful to ensure safe and efficient operation of the transmission line.

SUMMARY

In general, this disclosure is directed to a connector cover for protecting a connector from exposure, for example, to environmental contaminants, physical damage or the like. In some examples, the connector cover includes a housing that houses the connector and a pair of doors positioned between an access opening of the housing and the connector. The pair of doors may bias together when the connector is not mated with a corresponding connector on the end of a transmission line so as to protect the connector from exposure. Further, the pair of doors may move apart in response to a user inserting the corresponding connector on the end of a transmission line into the access opening of the housing, thereby allowing the connector in the housing to mate with the corresponding connector on the transmission line. For example, as a distal end of the connector on the transmission line contacts a leading surface of the pair of doors, the doors may separate apart to allow the corresponding connector on the transmission line to enter the housing and mate with the connector. Removing the corresponding connector on the transmission line from the housing may cause the pair of doors to automatically close together, preventing environmental contaminants from reaching the connector in the housing.

Although the connector cover can have a variety of different configurations, in some examples, the connector cover is configured to open and close in response to a user inserting and removing a connector on a transmission line without requiring a user to further manipulate the connector cover. For example, the force of the transmission line connector contacting the pair of doors on the connector cover may be sufficient to open the doors without requiring a user to further manipulate the doors. In such a configuration, a user may grasp a transmission line and insert the connector on the transmission line into the access opening defined by the connector cover without touching the movable doors that open and close across the access opening. This can help maintain a sterile and contaminant free connection.

In one example, a connector system is described that includes a connector shroud attached to a transmission line and a connector shroud receiver configured to receive the connector shroud. The connector shroud extends from a shroud proximal end to a shroud distal end and defines an opening at the shroud distal end for accessing at least one connector positioned at a terminal end of the transmission line. The connector shroud receiver includes a receiver housing defining an opening into which the shroud distal end of the connector shroud can be inserted, the receiver housing housing at least one complementary connector to the connector positioned at the terminal end of the transmission line, a first door positioned between the opening defined by the receiver housing and the at least one complementary connector, and a second door positioned between the opening defined by the receiver housing and the at least one complementary connector. According to the example, the first door and the second door are configured to bias together when the connector shroud is not inserted into the receiver housing so as to close the opening defined by the receiver housing. The example further specifies that the first door and the second door are configured to move apart in response to the shroud distal end contacting the first door and the second door as the connector shroud is inserted into the receiver housing so as to allow the connector positioned at the terminal end of the transmission line to mate with the complementary connector housed in the receiver housing.

In another example, a connector cover is describes that includes a housing defining an opening configured to receive a connector positioned at a terminal end of a transmission line, a first door positioned to cover a first portion of the opening defined by the housing, and a second door positioned to cover a second portion of the opening defined by the housing. The housing is configured to house at least one complementary connector to the connector positioned at the terminal end of the transmission line. According to the example, the first door and the second door are configured to bias together when the connector is not inserted into the housing so as to close the opening defined by the housing. The example further specifies that the first door and the second door are configured to move apart in response to the connector contacting the first door and the second door as the connector is inserted into the housing so as to allow the connector to mate with the complementary connector housed in the receiver housing.

In another example, a method is described that includes inserting a connector shroud attached to a transmission line into an opening defined by a connector shroud receiver, the connector shroud receiver including a first door positioned to cover a first portion of the opening and a second door positioned to cover a second portion of the opening, and mating at least one connector positioned at a terminal end of the transmission line with at least one complementary connector housed in the connector shroud receiver. The example method specifies that in response to the connector shroud contacting the first door and the second door upon inserting the connector shroud, the first door and the second door move from a closed position in which the first door and the second door close the opening to an open position in which the first door and the second door are moved apart to provide access to the opening.

The details of one or more examples are set forth in the accompanying drawings and the description below. Other features, objects, and advantages will be apparent from the description and drawings, and from the claims.

DETAILED DESCRIPTION

Figure 1:
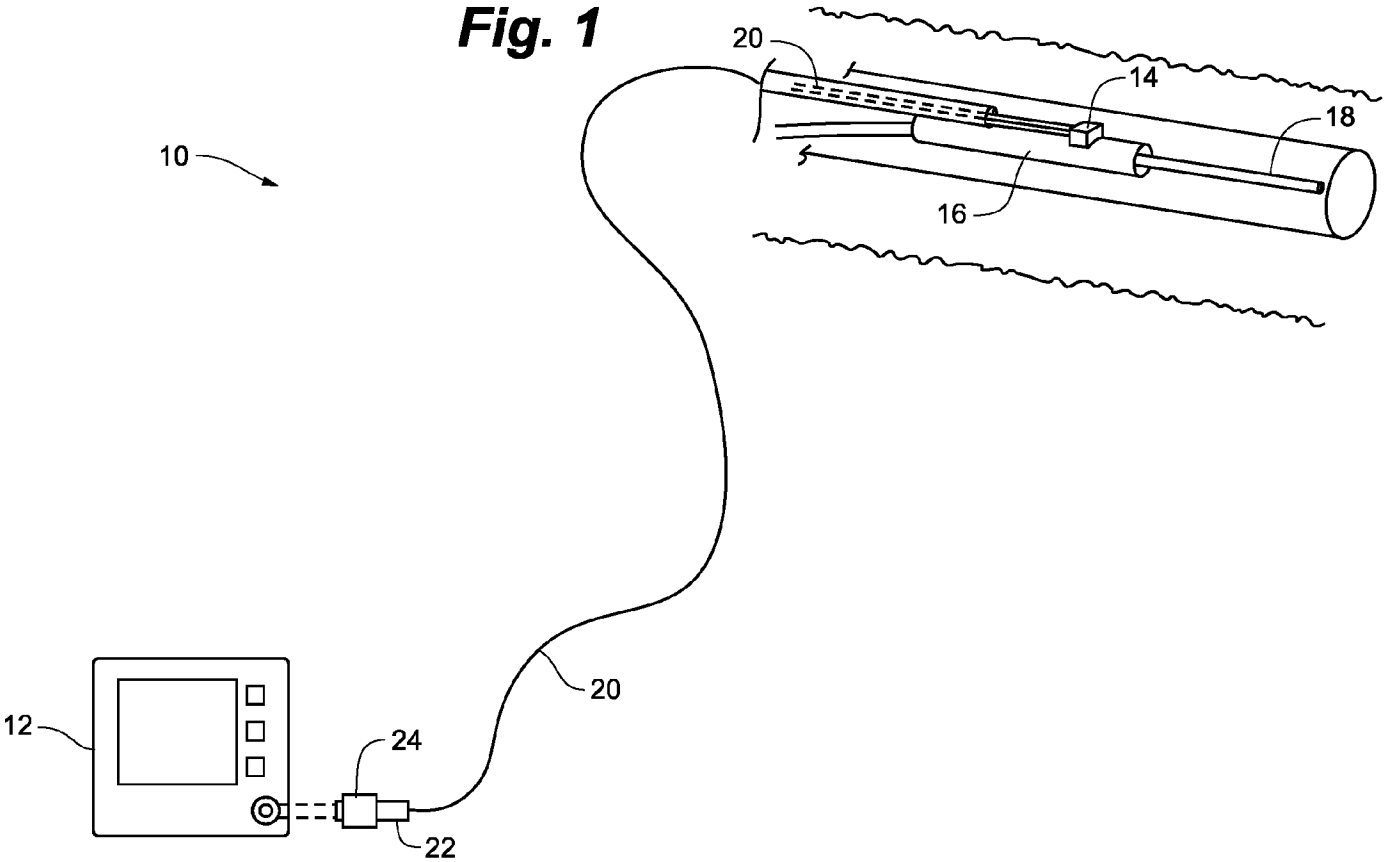
FIG. 1 is a conceptual view of an example medical system that may use a connector system in accordance with the disclosure.

The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

A transmission line can provide a pathway for conveying electrical signals, optical signals, fluid, or other media or combinations of media from one location to another location. For example, a transmission line can contain an electrically conductive cable for conveying electrical signals from one location to another location, a fiber optic cable for conveying optical signals from one location to another location, and/or a fluid lumen for conveying fluid from one location to another location. Because a transmission line can be used for conveying media from one location to another location, the transmission line typically includes a connector at one or both end of the line that can be used to attach the transmission line to another device that can receive and/or supply the media being conveyed through the transmission line.

Depending on the environment in which the transmission line is used, there may be fluid, dirt, debris, or other contaminants that can contact an exposed end of the transmission line and/or an exposed portion of the device to which the transmission line connects prior to connection. These contaminants can interfere with transfer of the media between the transmission line and device after the components are connected. Further, depending on the type of media being transferred between the transmission line and the device, these contaminates may adulterate the media itself, rendering the media unfit for subsequent use.

For example, in the medical field, a variety of devices include a sensor or therapy delivery element that is designed to be placed on or in a patient and coupled to a base station via a transmission line. The transmission line may convey communication signals between the base station and sensor or therapy delivery element, receive sampled signals or fluids from a patient, supply therapeutic agents to the patient, or the like. Accordingly, preventing contaminants from contacting the connector on the transmission line and/or a corresponding connector on the base station may help ensure the safe and efficient use of the device. For example, where the sensor or therapy delivery element and transmission line are single-use disposable components and the base station is a reusable component left in service for an extended period of time, it may be particularly useful to protect the connector on the base station from environmental containments that may be present in a medical facility.

This disclosure describes devices, systems, and techniques for protecting a connector from exposure to undesirable elements. In one example, a system is described that includes a connector shroud attached to a transmission line and a connector shroud receiver configured to receive the connector shroud. The connector shroud may project beyond the end of the transmission line so that a connector carried by the transmission line is recessed relative to the end of the shroud. This recessed configuration may protect the connector carried by the transmission line. The connector shroud receiver may house a complementary connector that is configured (e.g., sized and shaped) to mate with the connector carried by the transmission line. Although the design can vary, the connector shroud receiver may define an opening through which the connector shroud on the transmission line can be inserted. The connector shroud receiver may also include at least two doors positioned between the opening and the complementary connector housed by the connector shroud receiver. The doors may block environmental contaminants from contacting the complementary connector when the complementary connector is not connected to the transmission line.

During use when the connector on the transmission line is not mated to the complementary connector in the connector shroud receiver, the doors may bias together to close the opening positioned between the opening and the complementary connector housed by the connector shroud receiver. To open the doors, a user may press the leading edge of the connector shroud attached to the transmission line against the leading surface of the doors and advance the shroud through the doors. As the shroud physically contacts the doors, the shroud may push the doors apart so as to expose the opening through which the connector carried by the transmission line can engage the complementary connector carried by the receiver.

Different views of an example connector shroud and connector shroud receiver will be described in greater detail with respect to FIGS. 2-5. However, an example medical system that may use a connector shroud and connector shroud receiver will first be described with respect to FIG. 1.

FIG. 1 is a conceptual view of an example medical system 10 that may use a connector configuration in accordance with this disclosure. Medical system 10 includes a base unit 12, a sensor 14, a distal sleeve 16, and a medical guide wire 18. Sensor 14 is coupled to distal sleeve 16. Distal sleeve 16 is positioned over medical guide wire 18 and configured to slide along the guide wire to a desired location within a patient. For example, during use, distal sleeve 18 and, hence, sensor 14 attached to the distal sleeve, may be positioned within an anatomical structure of a patient such as, e.g., within a vein, artery, or other blood vessel, or across a heart valve. Sensor 14 may sense and/or measure a physiological parameter of a patient and generate a signal representative of the physiological parameter.

Data generated and/or sensed by sensor 14 may be communicated to base unit 12, which may be located outside of a patient in a sterile medical field. Base unit 12 may comprise a computer or other processing equipment that can control the operation of sensor 14, receive and process signals generated and/or sensed by sensor 14, display data generated using sensor 14, or the like. To communicate between base unit 12 and sensor 14, at least one transmission line 20 may extend between the base unit and the sensor.

Transmission line 20 can have a variety of different configurations. In one example, transmission line 20 is a fiber optic communication channel that can transmit optical energy between base unit 12 and sensor 14. In another example, transmission line 20 is an electrically conductive medium, such as one or more electrically conducting wires, that can transmit electrical energy between base unit 12 and sensor 14. In still other examples, transmission line 20 includes multiple transmission lines, such as a fiber optic line and an electrically conductive line, to transmit both optical energy and electrical energy between base unit 12 and sensor 14. In such examples, the multiple transmission lines may extend through a common lumen or sheath defined by transmission line 20 or may be physically separate lines extending between base unit 12 and sensor 14. The number and configuration of transmission lines may depend on the type of sensor selected for sensor 14. In general, transmission line 20 may be implemented using any variety of fluid or non-fluid media.

To connect transmission line 20 to base unit 12, the transmission line may carry a connector 22 positioned at a terminal end of the line that is configured (e.g., sized and/or shaped) to mate with a complementary connector 24 carried by base unit 12. For example, rather than being permanently connected, transmission line 20 may be detachably connected to base unit 12 via connector 22. Such an arrangement may allow base unit 12 to be disconnected from sensor 14 and reconnected to a different sensor, e.g., for either the same patient or a different patient. This may allow a relatively inexpensive sensor 14 to be discarded or taken out of service for sterilization while the relative more expensive base unit 12 remains in service.

Connector 22 is configured to mate with complementary connector 24 to establish a continuous transmission line between sensor 14 and base unit 12. In some examples, connector 22 is a female connector that defines a port for receiving a corresponding male connector defined by complementary connector 24. In other examples, connector 22 is a male connector that defines a protrusion for receiving a corresponding female connector defined by complementary connector 24. Other types of connector and complementary connector structures are possible, as will be appreciated by those of ordinary skill in the art, and it should be appreciated that the disclosure is not limited to a connector or complementary connector having any particular type of design. Further, in instances in which transmission line 20 includes multiple transmission lines extending between base unit 12 and sensor 14, each transmission line may or may not carry a separate connector 22 that is configured to mate with a separate complementary connector 24 associated with base unit 12.

During use, a user may grasp connector 22 carried by transmission line 20 and engage the connector with complementary connector 24 associated with base unit 12 so as to establish communication (e.g., electrical communication, optical communication, fluid communication) between sensor 14 and the base unit. Depending on the configuration of medical system 10, if contaminants such as fluid, dust, or debris enter the space between connector 22 and complementary connector 24 before or during mating, the contaminants may impact the quality of transmission between base unit 12 and sensor 14 during subsequent use. For these and other reasons, connector 22 and/or complementary connector 24 may be equipped with a connector cover as described herein.

Figure 2:
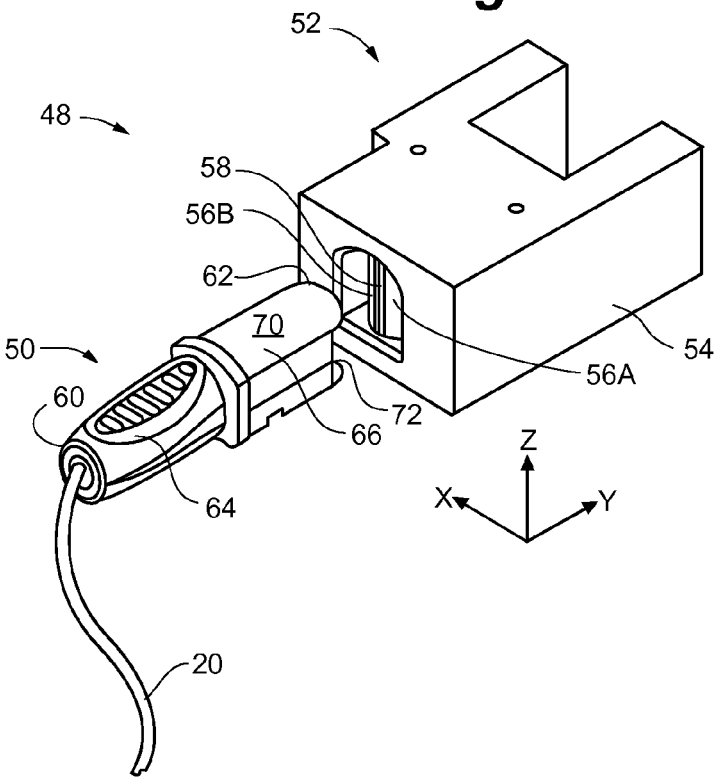
FIG. 2 is perspective view of an example connector system that may be used in the example medical system of FIG. 1.
Figure 3:
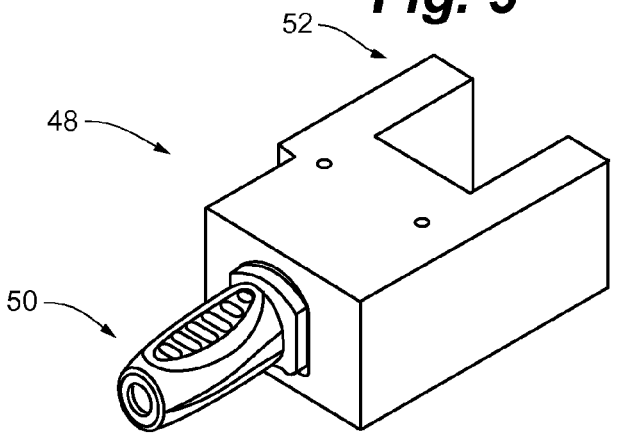
FIG. 3 is perspective view of the example connector system of FIG. 2 showing an example connector shroud inserted into an example connector shroud receiver.

FIG. 2 is perspective view of an example connector system 48 in accordance with the disclosure. Connector system 48 can be used with medical system 10 of FIG. 1 or other types of systems as described herein. Connector system 48 includes a connector shroud 50 and a connector shroud receiver 52. Connector shroud 50 may protect connector 22 (FIG. 1) carried by transmission line 20 from contact with contaminants, inadvertent physical contact, or the like. Connector shroud receiver 52 houses complementary connector 24 (FIG. 1) and may protect the complementary connector from contact with contaminants, inadvertent physical contact, or the like. To mate connector 22 with complementary connector 24, connector shroud 50 can be inserted into connector shroud receiver 52, e.g., by advancing the connector shroud in the Y-direction indicated on FIG. 2. As connector shroud 50 is inserted into connector shroud receiver 52, the connector shroud receiver may open so as to allow connector 22 to engage with complementary connector 24. FIG. 2 illustrates connector shroud 50 as being positioned outside of and insertable into connector shroud receiver 52. FIG. 3 illustrates connector shroud 50 inserted into connector shroud receiver 52, e.g., with connector 22 mated with complementary connector 24.

With further reference to FIG. 2, connector shroud receiver 52, which may also generally be referred to as a connector cover, is configured to hold complementary connector 24 (FIG. 1) and to cover the complementary connector when not engaged with connector 22 on transmission line 20. Connector shroud receiver includes a housing 54 and at least one door which, in the illustrated example, is shown as two doors: first door 56A and second door 56B (collectively "doors 56"). As described in greater detail below, doors 56 may close (e.g., as illustrated in FIG. 2) when connector shroud 50 is not inserted into connector shroud receiver 52 and open when the connector shroud is inserted into the connector shroud receiver. In this way, doors 56 can provide selective access to complementary connector 24 so as to cover a mating surface of the complementary connector when not engaged and so as to expose the mating surface of the complementary connector for engagement with connector 22.

Housing 54 of connector shroud receiver 52 can house complementary connector 24. In general, housing 54 may be any structure that is capable of containing a complementary connector. In different examples, housing 54 may surround complementary connector 24 on all sides of the connector so as to completely enclose the connector or housing 54 may cover fewer than all sides of the complementary connector. For instance, housing 54 may be a surface to which complementary connector 24 is attached and which guides movement of doors 56 without surrounding the connector. In the example of FIG. 2, housing 54 is illustrated as an independent structure. In other examples, housing 54 may be integrated with or defined by another structure (e.g., a portion of base unit 12 in FIG. 1).

To provide access to the complementary connector 24 contained by housing 54, the housing may define an opening 58 that is configured (e.g., sized and shaped) to receive connector shroud 50. In such an example, doors 56 may be positioned between opening 58 and a portion of complementary connector 24 to which connector 22 mates. Depending on the configuration of connector shroud receive 52, doors 56 may bias together when connector shroud 50 is not inserted into opening 58 so as block access to complementary connector 24. For example, when doors 56 are closed, the doors may provide a layer of material between the portion of complementary connector 24 to which connector 22 mates and potential contaminants in the ambient environment surrounding housing 54. Doors 56 may also be configured to move apart as connector shroud 50 is inserted into opening 58, for example in response to the force of the connector shroud contacting the doors, so as to allow connector 22 protected by the shroud to mate with complementary connector 24 contained within the housing.

In general, connector shroud 50 is a structure that helps protect connector 22 carried by transmission line 20 from contamination or other damage during use. Connector shroud 50 extends from a shroud proximal end 60 to a shroud distal end 62. Connector shroud 50 may define an opening at shroud distal end 62 through which connector 22 is accessed. For example, as connector shroud 50 is inserted into connector shroud receiver 52, complementary connector 24 may enter the opening defined by shroud distal end 62 so as to establish a connection between connector 22 and complementary connector 24.

In the example of FIG. 2, connector shroud 50 defines an external gripping surface 64 and an external insertion surface 66 positioned between shroud proximal end 60 and shroud distal end 62. External gripping surface 64 is a surface of connector shroud 50 that is intended to be grasped by a user when inserting connector shroud 50 into connector shroud receiver 54. External gripping surface 64 may or may not have ribs and grooves or other tactile features to help a user grip connector shroud 50. External insertion surface 66 is a portion of connector shroud 50 that is intended to be inserted into connector shroud receiver 52. When inserted, external insertion surface 66 may be enclosed by housing 54 of connector shroud receiver 52. In other examples, connector shroud 50 may not have external gripping surface 64. Rather, the entire connector shroud 50 may be designed to be inserted into connector shroud housing 52. In such examples, a user may grip transmission line 20 rather than external gripping surface 64 so as to insert connector shroud 50 into the connector shroud receiver 52.

Connector 22 carried by transmission line 20 can be positioned at any suitable location relative to connector shroud 50. In some examples, connector shroud 50 is located on a terminal end of transmission line 20 so that connector 22 is positioned to be flush with or extending outward from shroud distal end 62. In other examples, connector shroud 50 is located on a terminal end of transmission line 20 so that connector 22 recessed within the connector shroud. For example, connector shroud 50 may project distally off a terminal end of transmission line 20 so that connector 22 carried at the terminal end of the transmission line is positioned inside of the connector shroud. In such an example, a sidewall of connector shroud 50 may extend beyond connector 22 (e.g., in the Y-direction indicated on FIG. 1) rather than having the connector extend beyond shroud distal end 62. Such a configuration may be useful in that the sidewall of connector shroud 50 may protect the connector positioned within the shroud from contamination, e.g., caused by inadvertently contacting the connector with a contamination source.

Figure 4:
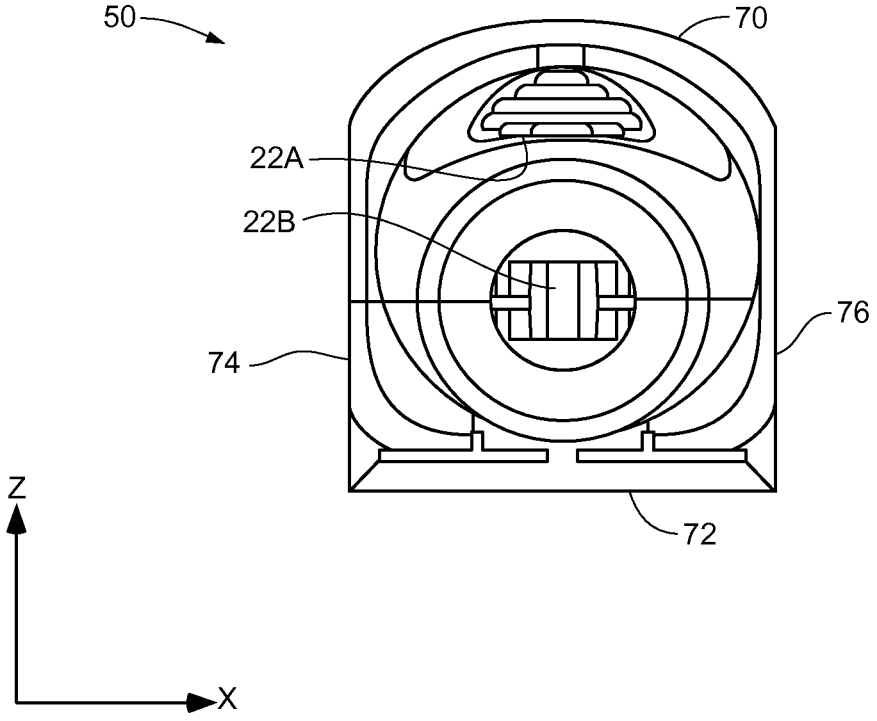
FIG. 4 is a side view of an example connector shroud that can be used in the example connector system of FIGS. 2 and 3.

Connector shroud 50 can have a variety of different sizes and shapes. FIG. 4 is a side view of one example of connector shroud 50 looking at shroud distal end 62 in the X-Z plane indicated on FIG. 2. In this example, connector shroud 50 defines a top surface 70, a bottom surface 72, a first side surface 74 connecting top surface 70 to bottom surface 72, and a second side surface 76 connecting top surface 70 to bottom surface 72. Bottom surface 72, first side surface 74, and second side surface 76 are illustrated as being planar surfaces while top surface is illustrated as being a curved surf ace. By providing at least one surface of connector shroud 50 that is a different size and/or shape than other surfaces of the connector shroud, the connector shroud may define a single three-dimensional orientation in which a user can insert the connector shroud into opening 58. Such a configuration may help ensure that a user inserts connector shroud 50 into connector shroud receiver 52 at an orientation that will allow connector 22 to mate with complementary connector 24.

While connector shroud 50 is illustrated as defining a substantially square shape with a rounded top surface, in other examples connector shroud 50 can define other shapes. Connector shroud 50 can define any polygonal (e.g., square, hexagonal) or arcuate (e.g., circular, elliptical) shape, or combinations of polygonal and arcuate shapes. The specific shape of connector shroud 50 may vary, e.g., based on the specific shape of opening 58 of connector shroud receive 52 (FIG. 2).

Independent of the specific shape of connector shroud 50, the connector shroud may have a shape that corresponds to the shape of opening 58 defined by connector shroud receiver 52. For example, the cross-sectional shape of connector shroud 50 (i.e., in the X-Z plane indicated on FIG. 4) may be complementary (e.g., the same) as the cross-sectional shape of opening 58 defined by connector shroud receiver 52 (i.e., in the X-Z plane indicated on FIG. 2). Where connector shroud 50 and/or opening 58 define asymmetrical shapes, the complementary cross-sectional shapes may provide a lock-and-key arrangement guiding a user to insert the connector shroud 50 into opening 58 in a particular orientation.

As briefly discussed above with respect to FIG. 2, connector 22 carried by transmission line 20 can be positioned at any suitable location relative to connector shroud 50. In the example of FIG. 4, transmission line 20 is illustrated as carrying two connectors: first connector 22A and second connector 22B. First connector 22A is positioned inside of connector shroud 50 and attached to top surface 70. Second connector 22B is positioned inside of connector shroud 50 and is substantially centered in the connector shroud. When inserted into connector shroud receiver 52 (FIG. 2), first connector 22A can mate with a first complementary connector housed in connector shroud receiver 52, and second connector 22B can mate with a second complementary connector housed in the connector shroud receiver. In some examples, first connector 22A is an electrical connector while second connector 22B is an optical connector. It should be appreciated however, that a connector system in accordance with the disclosure can have fewer connectors (e.g., a single connector), more connectors (e.g., three, four, or more connectors), or a different physical arrangement of connectors, and the disclosure is not limited in this respect.

In addition, although connector system 48 (FIG. 2) is described as including a connector shroud 50 and connector shroud receiver 52, in other examples, connector shroud receiver 52 may be used without connector shroud 50. For example, a user may insert connector 22 carried at the terminal end of transmission line 20 directly through doors 56 and opening 58 of connector shroud receiver 52 without the benefit of connector shroud 50. Therefore, although opening 58 of connector shroud receiver 52 may be configured (e.g., sized and/or shaped) to receive connector shroud 50, the opening may be configured to receive connector 22 carried by transmission line 20 independent of whether the connector is surrounded by connector shroud 50.

Figure 5B:
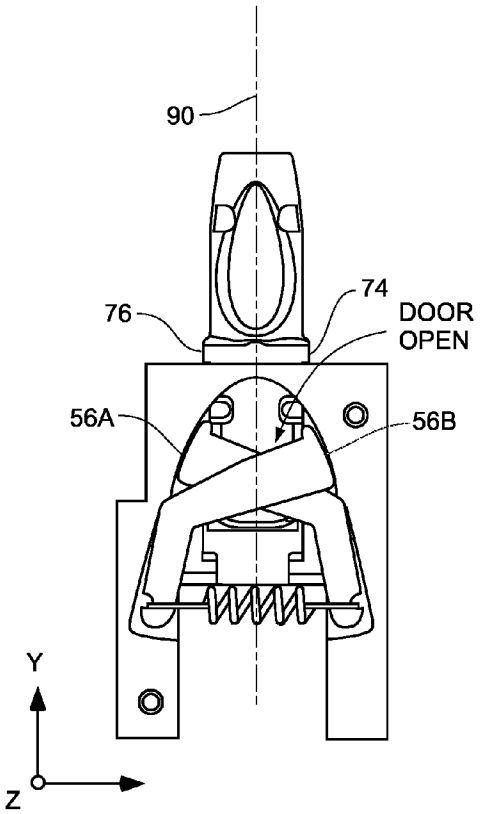
FIGS. 5A and 5B are different bottom views of an example connector shroud receiver that can be used in the example connector system of FIGS. 2 and 3.
Figure 5A:
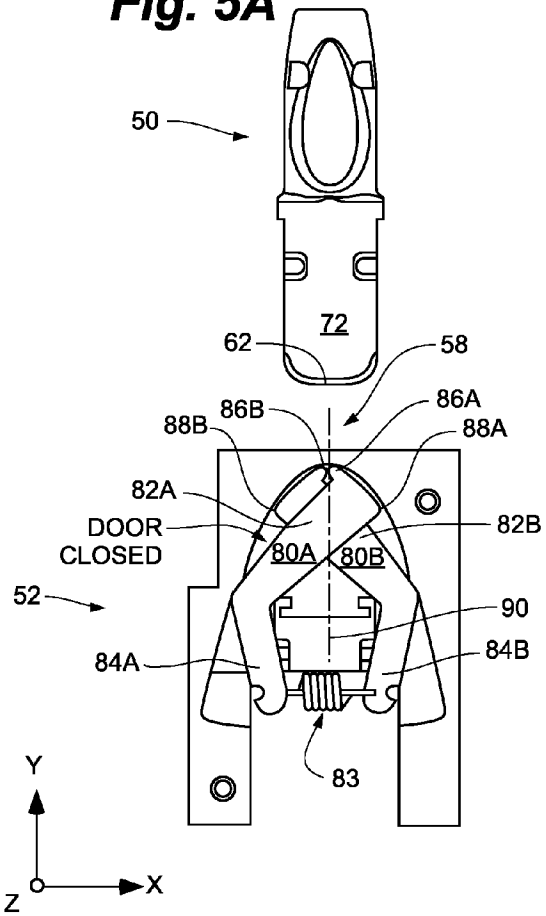

Connector shroud receiver 52 (FIG. 2) may close access to complementary connector 24 when not engaged with connector 22, e.g., so as to help prevent contaminants from contacting the complementary connector, and provide access to the connector upon insertion of connector 22 into the connector shroud receiver. FIGS. 5A and 5B are bottom views of connector shroud receiver 52 (e.g., from the perspective of the Z-direction indicated on FIG. 2) showing example components that may be included in the connector shroud receiver. FIG. 5A illustrates connector shroud 50 positioned outside of and insertable into connector shroud receiver 52. FIG. 5B illustrates connector shroud 50 inserted into connector shroud receiver 52, e.g., with connector 22 mated with complementary connector 24.

In the example of FIGS. 5A and 5B, connector shroud receiver 52 includes a first door 56A positioned between a portion of opening 58 and complementary connector 24 (not illustrated in FIGS. 5A and 5B) and a second door 56B position between a different portion of opening 58 and the complementary connector. When closed as illustrated in FIG. 5A, first door 56A and second door 56B close opening 58, e.g., so as to protect complementary connector 24 from contamination.

To facilitate opening and closing of first door 56A and second door 56B, first door 56A is connected to first door arm 80A and second door 56B is connected to second door arm 80B. First door arm 80A and second door arm 80B are further connected to a biasing member 83, which is configured to bias first door 56A and second door 56B together when connector shroud 50 is not inserted into connector shroud receiver 52. Biasing member 83 may further allow first door 56A and second door 56B to move apart, thereby exposing opening 58, e.g., in response to shroud distal end 62 of connector shroud 50 contacting and advancing into connector shroud receiver 52.

In the particular example of FIGS. 5A and 5B, first door arm 80A extends from a front end 82A adjacent opening 58 to a rear end 84A, and second door arm 80B extends from a front end 82B adjacent opening 58 to a rear end 84B. First door 56A is positioned on a front portion of first door arm 80A while second door 56B is positioned on a front portion of second door arm 80B. In different examples, first door 56A and second door 56B may be integrally formed (e.g., permanently cast or molded) to the door arms or may be separate components that are mechanically affixed to the door arms. In either set of examples, biasing member 83 may be attached to a rear portion of first door arm 80A and a rear portion of second door arm 80B so as to bias first door 56A and second door 56B closed.

When configured as illustrated in FIGS. 5A and 5B, first door arm 80A overlaps second door arm 80B so that front portion 82A of first door arm 80A is positioned on an opposite side of housing 54 than rear portion 84A and front portion 82B of second door arm 80B is positioned on an opposite side of the housing than rear portion 84B. In such an example, first door 56A may move apart from second door 56B when rear portion 84A of first door arm 80A is moved away from rear portion 84B of second door arm 80B. Conversely, first door 56A may close together with second door 56B when rear portion 84A of first door arm 80A is moved toward rear portion 84B of second door arm 80B. To bias first door 56A and second door 56B together when connector shroud 50 is not inserted into connector shroud receiver 52 in such an example, biasing member 83 may be implemented as an extension spring that resists a pulling force in a direction of the length of the spring. In different examples, different types or different numbers of biasing members may be used. For example, each arm of connector shroud receiver 52 may be connected to a separate biasing member rather than being connected to a shared biasing member.

In addition, in other examples, first door arm 80A and second door arm 80B may not overlap with one another. In these examples, first door 56A may move apart from second door 56B when rear portion 84A of first door arm 80A is moved toward rear portion 84B of second door arm 80B. Further, first door 56A may close together with second door 56B when rear portion 84A of first door arm 80A is moved away from rear portion 84B of second door arm 80B. To bias first door 56A and second door 56B together in such examples, biasing member 83 may be implemented as a compression spring that resists forces trying to compress the spring in a direction of the length of the spring.

When connector shroud 50 is not inserted into connector shroud receiver 52, first door 56A and second door 56B may automatically close together (e.g., under the force of biasing member 83), so as to close opening 58 between complementary connector 24 and an atmosphere surrounding the connector. First door 56A and second door 56B can have a number of different configurations. However, in the example of FIGS. 5A and 5B, first door 56A defines a first door leading edge 86A and a first door trailing edge 88A while second door 56B defines a second door leading edge 86B and a second door trailing edge 88B. When closed, first door leading edge 86A may contact second door leading edge 86B, e.g., so that contaminants cannot pass through the junction between the two doors.

To help facilitate the insertion of connector shroud 50 into connector shroud receiver 52, first door leading edge 86A and second door leading edge 86B may be offset from first door trailing edge 88A and second door trailing edge 88B. For example, in FIG. 5A first door leading edge 86A is offset from first door trailing edge 88A (i.e., in the Y-direction indicated on the figure), and second door leading edge 86B is offset from second door trailing edge 88B (also in the Y-direction indicated on the figure). In this configuration, first door leading edge 86A and second door leading edge 86B are positioned within a first plane (e.g., a first X-Z plane) while first door trailing edge 88A and second door trailing edge 88B are positioned within a second plane (e.g., a second X-Z plane) that is offset from the first plane. Accordingly, first door leading edge 86A and second door leading edge 86B project towards a front face of connector shroud receiver 52 while first door trailing edge 88A and second door trailing edge 88B are recessed relative to the front face of the connector shroud receiver, providing doors that are angled relative to opening 58.

Angling first door 56A and second door 56B may be useful so that when connector shroud 50 is inserted into connector shroud receiver 52, shroud distal end 62 contacts first door leading edge 86A and second door leading edge 86B prior to (e.g., instead of) contacting first door trailing edge 88A and second door trailing edge 88B. This may help push the doors apart so that the connector shroud can be inserted farther into the connector shroud receiver. If the first door leading edge 86A and second door leading edge 86B are positioned within the same plane as first door trailing edge 88A and second door trailing edge 88B, the doors may not present a natural opening angle to assist opening of the doors. That being said, in other examples, first door leading edge 86A and second door leading edge 86B may be positioned within the same plane as first door trailing edge 88A and second door trailing edge 88B.

To establish a connection between connector 22 carried by transmission line 20 and complementary connector 24 housed by connector shroud receiver 52, a user may grasp external gripping surface 64 of connector shroud 50 and advance the connector shroud into opening 58 defined by housing 54. As a leading edge surface of connector shroud 50 physically contacts door 56, the force of the connector shroud impacting the doors may begin to push the doors apart. If the user continues to advance connector shroud 50 farther into connector shroud receiver 52, doors 56 may continue to spread apart until opening 58 is large enough to accept connector shroud 50.

In some examples, connector shroud 50 defines a leading edge to help guide doors 56 of connector shroud receiver 52 open. For example, connector shroud 50 may have a sidewall surface that projects distally from other sidewall surfaces of the connector shroud. The distally projecting sidewall surface may help pry doors 56 of connector shroud receive 52 open. With reference to FIG. 2, for example, top surface 70 and bottom surface 72 of connector shroud 50 both extend distally outward farther than first side surface 74 and second side surface 76. Accordingly, when a connector shroud having this configuration is inserted into connector shroud receiver 52, top surface 70 and bottom surface 72 of connector shroud 50 may contact doors 56 before other portions of the connector shroud contact the doors. This may help pry the doors open for easy insertion of the connector shroud into the connector shroud receiver.

When connector shroud 50 includes a distally projecting surface, the surface may or may not be in a different plane than the junction between first door 56A and second door 56B. In the example of FIG. 2, top surface 70 and bottom surface 72 each define a leading edge that is generally perpendicular to the junction between first door 56A and second door 56B. For example, top surface 70 and bottom surface 72 each extend distally in the general Y-direction indicated on FIG. 2 while the junction between first door 56A and second door 56B extends in the general Z-direction indicated on the figure. This configuration may help connector shroud 50 push doors 56 open as the connector shroud is inserted into the connector shroud receiver, e.g., in cases where first door 56A and second door 56B are independent actuatable and it is desirable to actuate both doors simultaneously.

With further reference to FIGS. 5A and 5B, when connector shroud 50 is advanced into housing 54 of connector shroud receiver 52, doors 56 may move from being positioned in front of the connector shroud to being positioned at the sides of the connector shroud. For instance, in the example of FIG. 5A and 5B, doors 56 are configured to move from a first position in which the doors intersect a vertical plane 90 (e.g., a vertical plane extending in the Z-direction indicated on FIGS. 5A and 5B), as illustrated in FIG. 5A, to a second position in which first door 56A and second door 56B are each generally parallel to vertical plane 90, as illustrated in FIG. B. When so configured, first door 56A and second door 56B may move from being perpendicular to a major axis of connector shroud 50 (e.g., an axis extending along the longest length of the connector shroud) to being generally parallel to the major axis. Thus, in some examples, when connector shroud 50 is inserted into connector shroud receiver 52, first door 56A is in contact with first side surface 74 of the connector shroud and second door 56B is in contact with second side surface 76. Further, shroud distal end 62 may be positioned distally past doors 56 so as to engage connector 22 with complementary connector 24.

Connector system 48 in FIGS. 2-5 may help protect exposed connectors from contamination and/or physical damage when not in use. Further, the connector system may allow a user to mate two or more different connectors using only one hand. Rather than being required to hold two separate connectors simultaneously or being required to use one hand to open connector cover doors while using another hand to insert a connector, a user may grasp the connector shroud and insert the connector shroud into the connector shroud receiver using a single hand. This may allow for simple and sterile engagement of two or more different connectors.

Various examples have been described. These and other examples are within the scope of the following claims.

The invention claimed is:

1. A connector system comprising:

a connector shroud attached to a transmission line, the connector shroud extending from a shroud proximal end to a shroud distal end and defining an opening at the shroud distal end for accessing at least one connector positioned at a terminal end of the transmission line; and a connector shroud receiver configured to receive the connector shroud, the connector shroud receiver comprising:

a receiver housing defining an opening into which the shroud distal end of the connector shroud can be inserted, the receiver housing housing at least one complementary connector to the connector positioned at the terminal end of the transmission line;

a first door positioned between the opening defined by the receiver housing and the at least one complementary connector, the first door defining a first door leading edge and a first door trailing edge; and a second door positioned between the opening defined by the receiver housing and the at least one complementary connector, the second door defining a second door leading edge and a second door trailing edge, wherein the first door and the second door are configured to bias together when the connector shroud is not inserted into the receiver housing so as to close the opening defined by the receiver housing, and the first door and the second door are configured to move apart in response to the shroud distal end contacting the first door and the second door as the connector shroud is inserted into the receiver housing so as to allow the connector positioned at the terminal end of the transmission line to mate with the complementary connector housed in the receiver housing, wherein, when the first door and the second door are biased together, the first door leading edge contacts the second door leading edge, and wherein, when the first door and the second door are biased together, the first door leading edge and the second door leading edge are positioned in a different plane than a plane containing the first door trailing edge and the second door trailing edge such that the shroud distal end is configured to contact the first door leading edge and the second door leading edge upon being inserted into the receiver housing prior to contacting the first door trailing edge and the second door trailing edge.

2. The connector system of claim 1, wherein the transmission line is at least one of an optical transmission line, an electrical transmission line, and a fluid transmission line.

3. The connector system of claim 1, wherein the transmission line comprises an optical transmission line and an electrical transmission line, the at least one connector positioned at the terminal end of the transmission line comprises an optical connector positioned at a terminal end of the optical transmission line and an electrical connector positioned at a terminal end of the electrical transmission line, and the at least one complementary connector housed in the receiver housing comprises a complementary optical connector and a complementary electrical connector.

4. The connector system of claim 1, wherein the connector shroud receiver defines a vertical plane extending through a center of the opening defined by the receiver housing, and the first door and the second door are configured to move from a first position in which the first door and the second door intersect the vertical plane when the first door and the second door are biased together to a second position in which the first door and the second door are generally parallel to the vertical plane when the connector shroud is inserted into the receiver housing.

5. The connector system of claim 1, wherein the connector shroud receiver further comprises a first door arm and a second door arm, the first door is positioned on a front portion of the first door arm, the second door is positioned on a front portion of the second door arm, and a rear portion of the first door arm is connected to a rear portion of the second door arm via a biasing member.

6. The connector system of claim 5, wherein the first door arm overlaps the second door arm so that the first door and the second door are configured to move apart when the rear portion of the first door arm is moved away from the rear portion of the second door arm.

7. The connector system of claim 1, wherein the shroud distal end extends beyond the terminal end of the transmission line so that the terminal end of the transmission line is recessed in the connector shroud from the opening defined at the shroud distal end.

8. The connector system of claim 1, wherein the opening defined by the receiver housing defines a cross-sectional shape and the connector shroud defines a complementary cross-sectional shape so that the connector shroud can only be inserted into the opening defined by the receiver housing when the connector shroud is in one specific orientation.

9. The connector system of claim 1, wherein the connector shroud defines a top surface, a bottom surface, a first side surface connecting the top surface to the bottom surface, and a second side surface connecting the top surface to the bottom surface, and wherein the first door and the second door are configured to move apart when the connector shroud is inserted into the receiver housing so that the first door is in contact with the first side surface of the connector shroud and the second door is in contact with the second side surface of the connector shroud.

10. A connector cover comprising:

a housing defining an opening configured to receive a connector positioned at a terminal end of a transmission line, the housing being configured to house at least one complementary connector to the connector positioned at the terminal end of the transmission line;

a first door positioned to cover a first portion of the opening defined by the housing, the first door defining a first door leading edge and a first door trailing edge; and a second door positioned to cover a second portion of the opening defined by the housing, the second door defining a second door leading edge and a second door trailing edge, wherein the first door and the second door are configured to bias together when the connector is not inserted into the housing so as to close the opening defined by the housing, and the first door and the second door are configured to move apart in response to the connector contacting the first door and the second door as the connector is inserted into the housing so as to allow the connector to mate with the complementary connector housed in the receiver housing, wherein, when the first door and the second door are biased together, the first door leading edge contacts the second door leading edge, and wherein, when the first door and the second door are biased together, the first door leading edge and the second door leading edge are positioned in a different plane than a plane containing the first door trailing edge and the second door trailing edge such that the connector is configured to contact the first door leading edge and the second door leading edge upon being inserted into the receiver housing prior to contacting the first door trailing edge and the second door trailing edge.

11. The connector cover of claim 10, wherein the at least one complementary connector comprises at least one of an optical connector and a fluid connector.

12. The connector cover of claim 10, further comprises a first door arm and a second door arm, the first door being positioned on a front portion of the first door arm, the second door being positioned on a front portion of the second door arm, and a rear portion of the first door arm being connected to a rear portion of the second door arm via a biasing member.

13. The connector cover of claim 12, wherein the first door arm overlaps the second door arm so that the first door and the second door are configured to move apart when the rear portion of the first door arm is moved away from the rear portion of the second door arm.

14. A method comprising:

inserting a connector shroud attached to a transmission line into an opening defined by a connector shroud receiver, the connector shroud receiver including a first door positioned to cover a first portion of the opening and a second door positioned to cover a second portion of the opening;

in response to the connector shroud contacting the first door and the second door upon inserting the connector shroud, moving the first door and the second door from a closed position in which the first door and the second door close the opening to an open position in which the first door and the second door are moved apart to provide access to the opening; and mating at least one connector positioned at a terminal end of the transmission line with at least one complementary connector housed in the connector shroud receiver, wherein the first door defines a first door leading edge and a first door trailing edge, the second door defines a second door leading edge and a second door trailing edge, and wherein, when the first door and the second door are biased together, the first door leading edge and the second door leading edge are positioned in a different plane than a plane containing the first door trailing edge and the second door trailing edge such that a distal end of the connector shroud is configured to contact the first door leading edge and the second door leading edge upon being inserted into the connector shroud receiver prior to contacting the first door trailing edge and the second door trailing edge.

15. The method of claim 14, wherein the transmission line is at least one of an optical transmission line, an electrical transmission line, and a fluid transmission line.

16. The method of claim 14, wherein the connector shroud receiver defines a vertical plane extending through a center of the opening, and moving the first door and the second door from the closed position to an open position comprises moving the first door and the second door from a first position in which the first door and the second door intersect the vertical plane to a second position in which the first door and the second door are generally parallel to the vertical plane.

17. The method of claim 14, wherein the connector shroud receiver further comprises a first door arm and a second door arm, the first door being positioned on a front portion of the first door arm, the second door being positioned on a front portion of the second door arm, and a rear portion of the first door arm being connected to a rear portion of the second door arm via a biasing member.

18. A connector system comprising:

a connector shroud attached to an optical transmission line and an electrical transmission line, the connector shroud extending from a shroud proximal end to a shroud distal end and defining an opening at the shroud distal end for accessing an optical connector positioned at a terminal end of the optical transmission line and an electrical connector positioned at a terminal end of the electrical transmission line; and a connector shroud receiver configured to receive the connector shroud, the connector shroud receiver comprising:

a receiver housing defining an opening into which the shroud distal end of the connector shroud can be inserted, the receiver housing housing a complementary optical connector to the optical connector positioned at the terminal end of the optical transmission line and a complementary electrical connector to the electrical connector positioned at the terminal end of the electrical transmission line;

a first door positioned between the opening defined by the receiver housing and the complementary optical connector and the complementary electrical connector; and a second door positioned between the opening defined by the receiver housing and the complementary optical connector and the complementary electrical connector, wherein the first door and the second door are configured to bias together when the connector shroud is not inserted into the receiver housing so as to close the opening defined by the receiver housing, and the first door and the second door are configured to move apart in response to the shroud distal end contacting the first door and the second door as the connector shroud is inserted into the receiver housing so as to allow the optical connector positioned at the terminal end of the optical transmission line and the electrical connector positioned at the terminal end of the electrical transmission line to mate with the complementary optical connector and complementary electrical connector, respectively, housed in the receiver housing.

19. The connector system of claim 18, wherein the connector shroud receiver defines a vertical plane extending through a center of the opening defined by the receiver housing, and the first door and the second door are configured to move from a first position in which the first door and the second door intersect the vertical plane when the first door and the second door are biased together to a second position in which the first door and the second door are generally parallel to the vertical plane when the connector shroud is inserted into the receiver housing.

20. The connector system of claim 18, wherein the connector shroud receiver further comprises a first door arm and a second door arm, the first door is positioned on a front portion of the first door arm, the second door is positioned on a front portion of the second door arm, and a rear portion of the first door arm is connected to a rear portion of the second door arm via a biasing member.

21. The connector system of claim 20, wherein the first door arm overlaps the second door arm so that the first door and the second door are configured to move apart when the rear portion of the first door arm is moved away from the rear portion of the second door arm.

22. The connector system of claim 18, wherein the shroud distal end extends beyond the terminal end of the optical transmission line and the terminal end of the electrical transmission line so that the terminal end of the optical transmission line and the terminal end of the electrical transmission line are recessed in the connector shroud from the opening defined at the shroud distal end.

23. The connector system of claim 18, wherein the opening defined by the receiver housing defines a cross-sectional shape and the connector shroud defines a complementary cross-sectional shape so that the connector shroud can only be inserted into the opening defined by the receiver housing when the connector shroud is in one specific orientation.

24. The connector system of claim 18, wherein the connector shroud defines a top surface, a bottom surface, a first side surface connecting the top surface to the bottom surface, and a second side surface connecting the top surface to the bottom surface, and wherein the first door and the second door are configured to move apart when the connector shroud is inserted into the receiver housing so that the first door is in contact with the first side surface of the connector shroud and the second door is in contact with the second side surface of the connector shroud.

* * * * *